US006399194B1

(12) United States Patent
Kunisada et al.

(10) Patent No.: US 6,399,194 B1
(45) Date of Patent: Jun. 4, 2002

(54) POLYPROPYLENE TEREPHTHALATE TWISTED YARN AND METHOD FOR PRODUCING THE SAME

(75) Inventors: Hideaki Kunisada; Katsuhiko Mochizuki; Koji Sugano; Yuhei Maeda, all of Shizuoka (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/856,673

(22) PCT Filed: Sep. 26, 2000

(86) PCT No.: PCT/JP00/06602

§ 371 (c)(1),
(2), (4) Date: May 24, 2001

(87) PCT Pub. No.: WO01/23651

PCT Pub. Date: Apr. 5, 2001

(30) Foreign Application Priority Data

Sep. 28, 1999 (JP) ..... 11-274308

(51) Int. Cl.[7] ..... D01F 6/00; D01F 6/62; D02G 1/02; D02G 3/02

(52) U.S. Cl. ..... 428/357; 428/364; 428/394; 57/247; 57/251; 57/284; 57/330

(58) Field of Search ..... 428/357, 369, 428/364, 394; 57/247, 251, 284, 286, 330

(56) References Cited

U.S. PATENT DOCUMENTS 3,828,542 A * 8/1974 Boutonnet et al. ..... 57/286

FOREIGN PATENT DOCUMENTS

| | | | |
|---|---|---|---|
| JP | 58-13746 | | 1/1983 |
| JP | 9-78373 | | 3/1997 |
| JP | 2001164433 | * | 6/2001 |

* cited by examiner

*Primary Examiner*—Newton Edwards
(74) *Attorney, Agent, or Firm*—Schnader Harrison Segal & Lewis LLP

(57) ABSTRACT

The present invention offers polypropylene terephthalate textured yarn which has little dyeing unevenness or fibrillation, and is outstanding in its product quality, by carrying out texturing at the same time as drawing under specified conditions using polypropylene undrawn yarn; together with a method for the production thereof.

20 Claims, 6 Drawing Sheets

POLYPROPYLENE TEREPHTHALATE TWISTED YARN AND METHOD FOR PRODUCING THE SAME

TECHNICAL FIELD

The present invention relates to polypropylene terephthalate textured yarn which, while making the most of the softness and stretchability of polypropylene terephthalate, can effectively confer bulkiness and a sense of tightness when in the form of a fabric such as a woven or knitted material; and to an industrially outstanding method for the production thereof.

PRIOR ART

As polyester textured yarn, textured yarn comprising polyethylene terephthalate is outstanding in its crimp characteristics, weatherability and the like, and it is currently widely used. However, there is a need to further enhance the comfort in wearing, and a fibre of high stretchability is demanded. Thus, as described in JP-A-9-78373 and JP-A-11-93026, textured yarns employing polypropylene terephthalate have been proposed. These textured yarns are textured yarns with outstanding stretchability and bulkiness, having an elastic recovery of at least 80% at the time of 50% elongation, a crimp development factor of 200–300% and a crimp recovery of 80%. However, in the case of these textured yarns, drawn yarn is subjected to so-called spindle texturing and the processing rate is slow, being at most 100 m/min, and not only are production costs high but there is also considerable variation between spindles and within a spindle, and there are problems in terms of quality. Furthermore, because of the low Young's modulus of no more than 30 g/d, there are problems in applying tightness.

OBJECTIVE OF THE PRESENT INVENTION

The objective of the present invention is to provide a method for the production of textured yarn of high quality and at low cost from polypropylene terephthalate which is outstanding in its stretchability and bulkiness; together with polypropylene terephthalate textured yarn which, in terms of its handle, is outstanding in its sense of tightness.

DISCLOSURE OF THE INVENTION

The method of the present invention for producing polypropylene terephthalate textured yarn which meets the aforesaid objective is characterized in that, when carrying out texturing at the same time as drawing using a frictional false-twisting machine, at the same time as setting the draw ratio of the polypropylene terephthalate undrawn yarn to 1.05–1.70, the elongation EL (%) of the undrawn yarn and the draw ratio DR are set so that the following relationship (1) is satisfied.

$$0.585\times(1+EL/100)\leqq DR\leqq 0.75\times(1+EL/100) \qquad \text{Realtionship (1)}$$

Furthermore, the polypropylene terephthalate textured yarn of the present invention is characterized in that it is produced by the above method.

EXPLANATION OF THE NUMERICAL CODES

Figure 1:
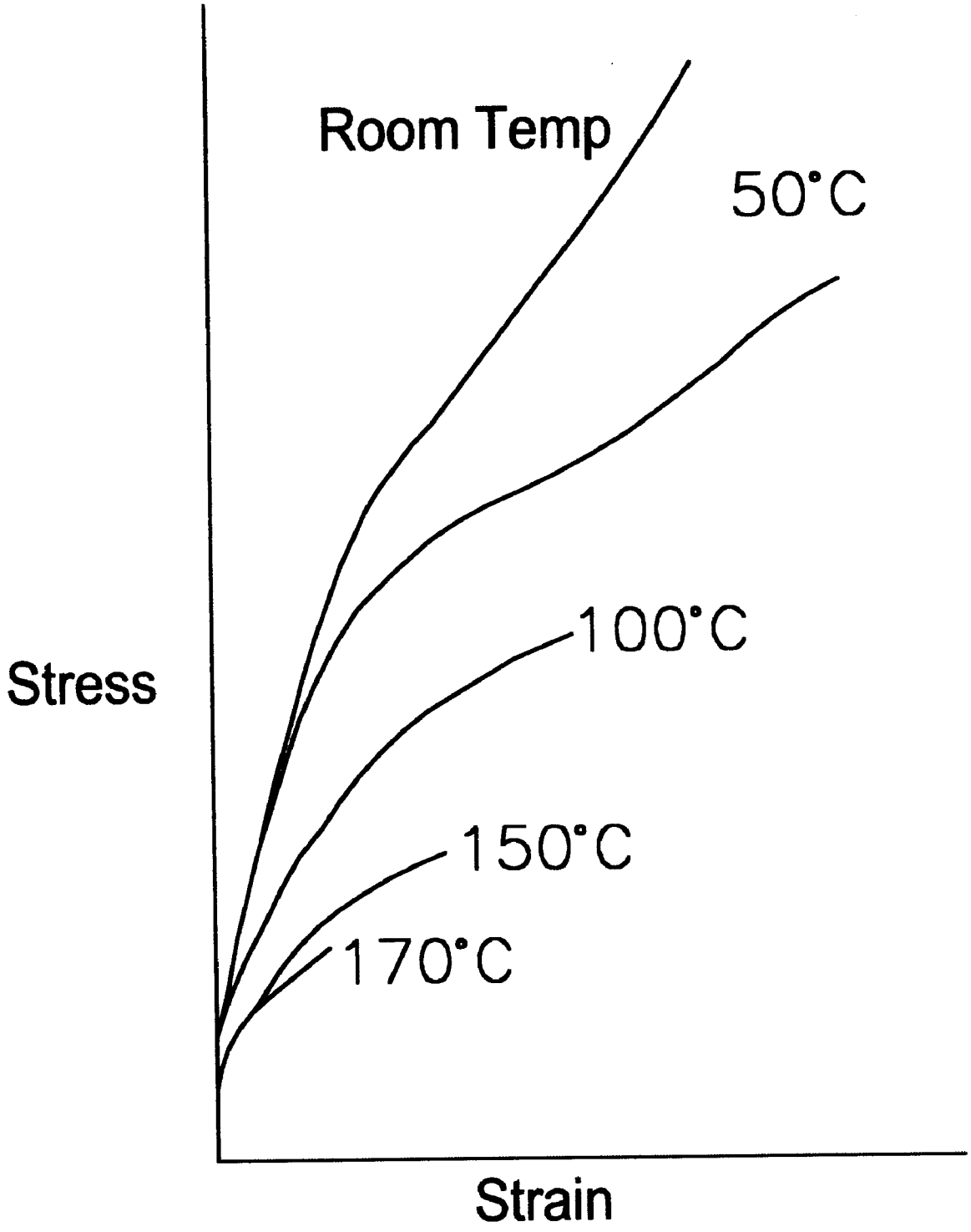
FIG. 1: This shows the stress-strain curve when polypropylene terephthalate drawn yarn was stretched with the atmospheric temperature varied from room temperature (25° C.) to 170° C.

1: undrawn yarn package
2: $1^{st}$ FR
3: heater
4: cooling plate
5: frictional false-twisting device
6: $2^{nd}$ FR
7: $3^{rd}$ FR
8: entangling nozzle
9: $4^{th}$ PR
10: winder
11, 18: spinning block
12, 19: oiling means
13, 20: undrawn yarn
14, 21: entangling nozzle
15, 22: first godet roll
16, 23: second godet roll
17, 24: winder
25: separating roll
26: spinneret
27: chimney
28, 32: non-contact heater
29: oiling means
30: entangling nozzle
31: first godet roll
33: second godet roll
34: winder

PRACTICAL FORM OF THE INVENTION

In the method of producing the polypropylene terephthalate textured yarn of the present invention, when carrying out the texturing at the same time as drawing using a frictional draw-texturing machine, at the same time as setting the draw ratio of the polypropylene terephthalate undrawn yarn to 1.05–1.70, the elongation EL (%) of the undrawn yarn and the draw ratio DR are set so that the following relationship (1) is satisfied.

$$0.585\times(1+EL/100)\leqq DR\leqq 0.75\times(1+EL/100) \qquad \text{Relationship (1)}$$

Here, the polypropylene terephthalate (abbreviated below to PPT) of the present invention is a polyester obtained from an acid component chiefly comprising terephthalic acid and a glycol component chiefly comprising 1,3-propanediol. However, it may also include other copolymer components which can form other ester linkages in a proportion not exceeding 20 mol % and more preferably not exceeding 10 mol %.

Examples of copolymerizable compounds are dicarboxylic acids such as isophthalic acid, succinic acid, cyclohexanedicarboxylic acid, adipic acid, dimer acid and sebacic acid, and glycol components such as ethylene glycol, diethylene glycol, butanediol, neopentyl glycol, cyclohexanedimethanol, polyethylene glycol and polypropylene glycol, but there is no restriction to these.

Furthermore, optionally, there may be added titanium dioxide as a delustring agent, fine particles of silica or alumina as a lubricant, a hindered phenol derivative as an antioxidant, or colouring pigments and the like.

The undrawn yarn comprising PPT is preferably fibre having a breaking elongation of from 60% to 180%. Such undrawn yarn is obtained for example using a normal spinning machine, with the PPT being melted in the usual manner and led into the spinning pack, and spinning carried out from the spinneret at a spinning rate of 2500 to 4500 m/min. The strength of the undrawn yarn obtained at a spinning rate of less than 2500 m/min is low, so considerable yarn breakage occurs in the draw texturing. Furthermore, undrawn yarn wound up at a spinning rate of 1000–2500 m/min displays marked change with elapse of time, so differences in fibre structure are produced between the centre and edge, and the inner and outside layers, of the undrawn package, resulting in problems such as uneven dyeing of the draw textured yarn in the yarn lengthwise direction occurring.

Again, in carrying out texturing at the same time as drawing at a draw ratio in the range from 1.05 to 1.70, it is preferred that there be employed a false-twisting machine comprising in turn a first feed roller ($1^{st}$ FR), a heater, a cooling plate, the frictional false-twisting device and a $2^{nd}$ feed roller (2nd FR), with drawing being carried out by a factor of 1.05 to 1.70 between the $1^{st}$ FR and the $2^{nd}$ FR, upstream twisting being effected by the frictional false-twisting device, heat-setting being conducted by means of the heater and fixing of the state being performed by means of the cooling plate. Again, for the purposes of obtaining thick/thin textured yarn where the thickness varies in the fibre axial direction, there may be carried out preliminary drawing within a range that does not exceed the natural draw ratio of the undrawn yarn, after which, without temporarily winding-up, the yarn is directly treated in the manner described above, with twist being applied upstream of the frictional false-twisting device using said frictional false-twisting device while drawing between the $1^{st}$ FR and $2^{nd}$ FR, and heat-setting being conducted by means of the heater and fixing of the state being performed by means of the cooling plate. However, in such circumstances, taking the draw ratio prior to the $1^{st}$ FR as $DR_0$ and the draw ratio between the $1^{st}$ FR and the $2^{nd}$ FR as $DR_1$, the value of DR obtained by multiplying these together, that is to say $DR=DR_0 \times DR_1$, will be from 1.05 to 1.70. Now, the preferred draw ratio range is 1.05 to 1.60, with the range 1.10 to 1.50 still further preferred.

Again, in the present invention, the elongation EL (%) of the undrawn yarn and the draw ratio DR in the draw-texturing are set such that the following relationship (1) is satisfied.

$$0.585\times(1+EL/100) \leqq DR \leqq 0.75\times(1+EL/100) \qquad \text{Relationship (1)}$$

When the draw ratio DR is less than 0.585×(1+EL/100), ballooning occurs during the draw-texturing process, processing becomes unstable and there are many yarn breaks. Moreover, if the elongation of the textured yarn exceeds 60%, when made into cloth there are problems in terms of product quality such as bagginess at the elbows. On the other hand, if the DR exceeds 0.75×(1+EL/100), the processing tension becomes too great, filament fibrillation occurs and, furthermore, there is considerable yarn breakage, and so this is undesirable. The specific draw ratio should be set in accordance with the properties of the polypropylene terephthalate undrawn yarn and the textured yarn, but it is preferred that it be such that the residual elongation is 20–60%, more preferably 25–55% and in particular 30–50%.

In order to enhance the stretchability and bulkiness of the cloth, it is necessary to enhance the crimp characteristics of the textured yarn, and to achieve this it is preferred that, in the draw texturing process, the yarn temperature at the heater outlet be made 30–175° C. Furthermore, in order to produce the cross-sectional deformations for providing the textured yarn with tightness, it is more preferred that the yarn temperature at the heater outlet be made 100–175° C. 110–160°0C. is still further preferred.

It has been newly discovered that if the stress-strain curve is measured while heating PPT, then, as shown in FIG. 1, the elongation and the strength are both markedly lowered by the heating. This is a phenomenon not found with polyethylene terephthalate or the like, and was regarded as a major problem for draw-texturing where drawing is carried out while heating. However, as a result of considerable research, it has been discovered that a texturing tension $T_1$ of 0.17 to 0.55 cN/dtex enables the texturing process to be carried out stably. When the texturing tension $T_1$ is in the range 0.17 to 0.55 cN/dtex, ballooning does not readily occur and fibrillation or yarn breaks do not tend to arise, so high-speed processing is possible. Furthermore, for the same reasons, it is further preferred that the texturing tension $T_1$ be in the range from 0.25 to 0.40 cN/dtex. Here, the texturing tension $T_1$ denotes the tension just prior to the frictional false-twisting device.

The Young's modulus of PPT is low, so there tends to be lower twist propagation upstream when compared to polyethylene terephthalate. In particular, if the yarn is not twisted over the heater positioned at the furthest point upstream, the fall in tension in the heater is considerable and, not only are the crimp characteristics lowered, but also there is considerable filament fibrillation and yarn breaks. Consequently, it is preferred that the ratio $T_1/T_H$ of the texturing tension $T_1$ to the tension prior to the heater $T_H$ be from 1.02 to 1.30. When the ratio $T_1/T_H$ of the texturing tension $T_1$ to the tension prior to the heater $T_H$ is in the range 1.02 to 1.30, there is little drop in tension within the heater, that is to say the twist from the frictional false-twisting device is fully manifested over the heater, and filament fibrillation and yarn breaks do not readily occur, so this is preferred. More preferably $T_1/T_H$ is 1.02 to 1.25. Here, the tension prior to the heater is the tension immediately before entering the heater.

The number of twists T inside the heater is preferably as high as possible but there are problems in the twist-conferring capacity of a frictional false-twisting device and, specifically, the number of twists T inside the heater is preferably from $27400/D^{1/2}$ to $30600/D^{1/2}$. In this way, it is possible to prevent fibrillation and yarn breaks inside the heater. For the same reasons, it is more preferred that the number of twists inside the heater is from $27900/D^{1/2}$ to $30100/D^{1/2}$. D denotes the fineness (decitex) of the textured yarn which has undergone the draw-texturing process.

Figure 2:
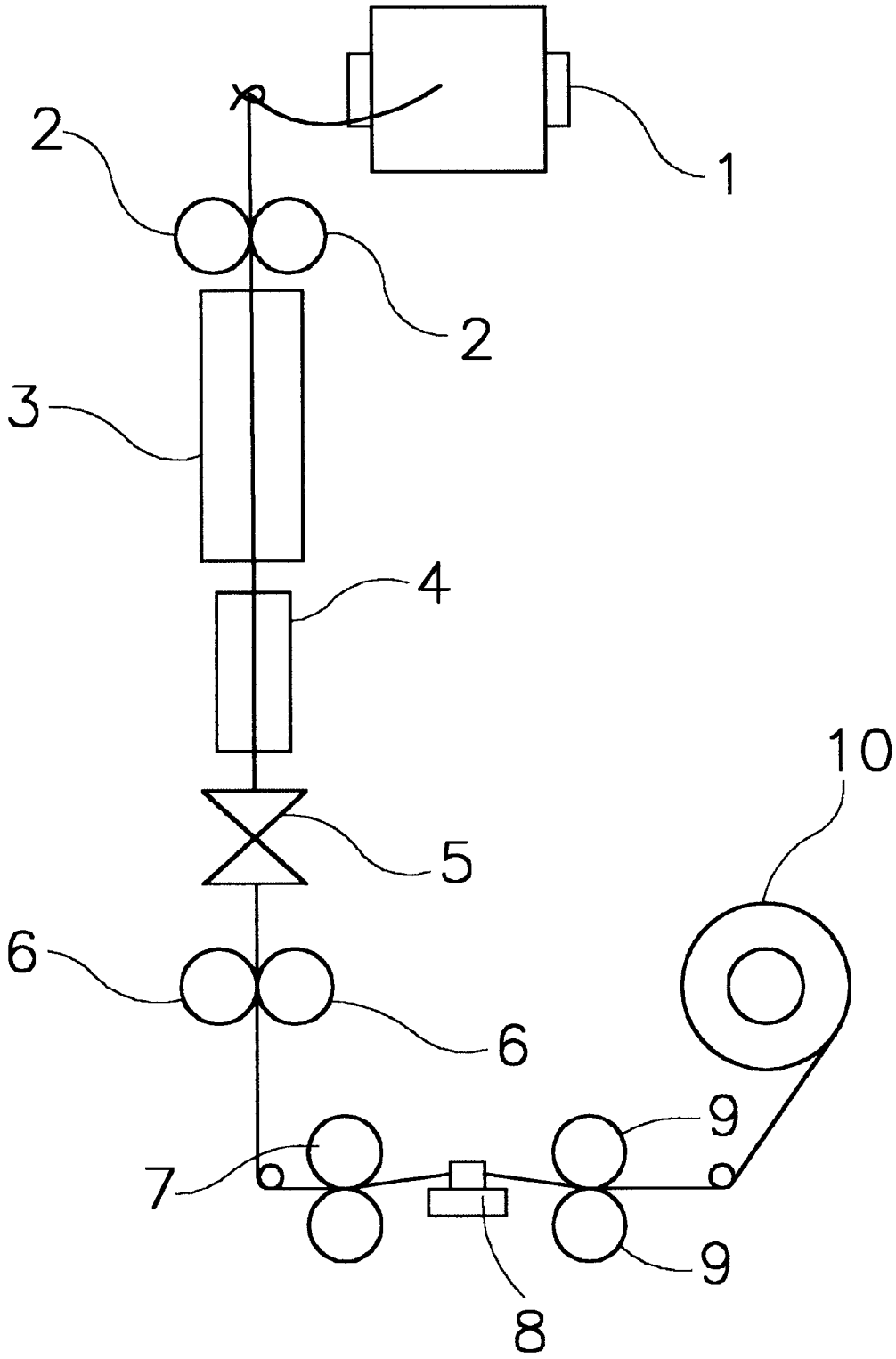
FIG. 2: This is a schematic diagram for explaining one example of the false-twisting machine relating to the present invention.

Next, using the drawings, explanation is given of the method of producing the PPT textured yarn of the present invention. An example of false twisting equipment relating to the present invention is shown in FIG. 2.

Using PPT undrawn yarn as the supplied raw yarn, while drawing is carried out between $1^{st}$ FR 2 and $2^{nd}$ FR 6, in the state with twist applied using frictional false-twisting device 5 the twisted form is heat-set by means of heater 3, and the form then fixed by means of cooling plate 4.

As stated earlier, since the Young's modulus of PPT is low, the propagation of the false twist upstream tends to be lowered, and so it is important in the twist zone to avoid ore than the required yarn bending and contact resistance.

Consequently, it is important that all the parts employed in the false-twisting machine be selected from the viewpoint of lowering the contact resistance. With regard to heater 3, there can be employed passage over a metal plate heated by means of an electrical heater or by heating and circulation of a heating medium, or there can be used the method of passage through a high temperature atmosphere. In the case of passage over a heated metal plate, it is preferred that this not be longer or bent more than is necessary, taking into account the yarn fineness, the processing rate and the desired texturing temperature. Furthermore, in the case of passage through a high temperature atmosphere, in order to raise the transit stability, it is preferred that there be used a so-called non-contact type high temperature heater with the yarn pathway fixed by guides or the like. In order to reduce fibrillation and breakage of the textured yarn, and in order to raise the processing rate, the use of a non-contact type high temperature heater of lower contact resistance is further preferred.

It is also preferred that the cooling plate 4 be no longer than necessary, and it is preferred that the cooling plate be shortened by cooling said cooling plate by the circulation of cooling water, or that the yarn be cooled at the same time as fumes are extracted by sucking-in air. Furthermore, with a cooling plate where slits are produced by means of metal plates and suction is applied from the rear so that the yarn is cooled by means of a cross-flow, the processing can be conducted stably with the frictional resistance lowered, the cooling capacity raised and the twist zone shortened, so this is preferably employed.

With regard to the frictional false-twisting device 5, providing it has both a twist-conferring action and a feeding action, it may be either an interior-contact type or exterior-contact type frictional false-twisting device, but there is preferably employed an exterior-contact type triaxial twister or belt nip twister.

The PPT undrawn yarn used as the supplied raw yarn tends to show delayed shrinkage following melt spinning and winding-up. In particular, undrawn yarn which has been wound-up at a spinning rate of 1000–2000 m/min shows a marked change in properties with elapse of time, so that differences in shrinkage arise between the edge face and centre of the package, or between the inner and outer layers, and lengthwise direction dyeing unevenness is produced in the draw-textured yarn. However, even at spinning rates in the region of 3000 m/min, delayed shrinkage is still produced and this causes yarn lengthwise dyeing unevenness to arise. Moreover, if the spinning rate is increased in order to reduce the delayed shrinkage, there is a higher degree of molecular orientation in the spinning line, so that the phenomenon of package tightening is produced with the result that it is no longer possible to remove the paper tube from the spindle. Hence, in order to resolve this problem, it is preferred that there be used, as the supplied raw yarn, undrawn PPT which satisfies the following four relationships (1) to (4).

(1) strength ST (cN/dtex): $1.8 \leqq ST$ (2) birefringence $\Delta n$ ($\times 10^{-3}$): $30 \leqq \Delta n \leqq 70$ (3) elongation EL (%): $60 \leqq EL \leqq 180$ (4) boiling water shrinkage SW (%): $3 \leqq SW \leqq 15$ In other words, with undrawn yarn showing these properties, there is practically no tightening of the undrawn yarn package due to delayed shrinkage and, as well as showing good texturing process properties, there are few defects such as dyeing unevenness, and a high quality textured yarn is produced.

The strength has a considerable influence on the process transit characteristics when carrying out drawing, false-twisting, warping and weaving, and on the mechanical properties of the cloth. In order to be satisfactory in terms of the productivity and product quality as aforesaid, it is preferred that the strength be at least 1.8 cN/dtex and more preferably at least 2.2 cN/dtex.

Again, in order to improve the processing characteristics in the drawing and texturing stage, it is preferred that the elongation be at least 60%. In terms of reducing unevenness in the thickness of the yarn obtained by drawing and false-twisting, to produce a more uniform yarn, it is preferred that the elongation be no more than 180%. The elongation range 70 to 150% is further preferred.

Moreover, the birefringence is closely related to the mechanical properties of the undrawn yarn and, in particular, in order to prevent fibrillation and breaks in the false-twisting process stage, and in order to obtain good process transit characteristics, it is preferred that the birefringence be at least 0.03. Furthermore, if the birefringence, exceeds 0.07, it becomes difficult to fully suppress package tightening or delayed shrinkage at high temperature. A more preferred range for the birefringence is 0.04 to 0.065.

Again, when PPT fibre is unwound from an undrawn yarn package and released from stress, it slowly shrinks, and a phenomenon referred to as delayed shrinkage is produced. This phenomenon also slowly proceeds within the package, and various problems arise such as the package shape being destroyed, unwinding being difficult, and unevenness being produced in the thickness of the yarn matching the package edge face period. Furthermore, this delayed shrinkage tends to be governed by the environmental temperature of the undrawn yarn and, in particular, since the environmental temperature reaches 50° C. in the case of summertime truck deliveries, the extent of the delayed shrinkage can be considerable. Hence, it is important that the fibre structure of the undrawn yarn be heat-stabilized at the yarn production stage. The stability of the fibre structure to heat can be ascertained from its boiling water shrinkage by introducing a sample into boiling water and measuring the shrinkage. If the boiling water shrinkage is less than 15%, there is little change with passage of time due to delayed shrinkage and the yarn can be said to have excellent heat stability. Furthermore, the boiling water shrinkage is closely related to the crimp setting property in the false-twisting process and with a percentage shrinkage of at least 3% excellent crimp setting is shown, The boiling water shrinkage is more preferably 5 to 12%.

Moreover, by having a low value of Uster unevenness, which is an index of the yarn thickness unevenness in the undrawn yarn lengthwise direction, not only is it possible to raise the process stability by suppressing fluctuations in the processing tension in the false-twisting process, but it is also possible to reduce defects such as dyeing unevenness in cloth derived from the yarn obtained, and it is possible to produce high quality products. Consequently, the Uster unevenness value of the undrawn yarn used is preferably no more than 1% and more preferably no more than 0.8%.

The undrawn yarn used is preferably wound into a cheese-shaped package. The shape of the package has an influence on the unwinding properties of the yarn in the false-twisting process, so a good package shape is required. Normally, where package shape is a problem is in terms of saddle and bulging, and if both these are small then the package is excellent in its high speed unwinding properties. In accordance with the method conceived by the present inventors, the fibre internal structure is stabilized prior to winding-up as a package, and so it is possible to produce a cheese of good package shape. The rate of unwinding required in false-twisting reaches 200–800 m/min, and in order that there be little variation in the unwinding tension at such rates and in order that yarn processing be carried out stably, it is preferred that the saddle be less than 4 mm and the bulging factor be less than 10%. More preferably, the saddle is less than 3 mm and the bulging factor is less than 7%. Now, the saddle and the bulging factor are measured using a 4 kg wound package.

Next, an example of the undrawn yarn production method preferably employed in the present invention is provided. Known methods can be used as they are for the production of the PPT which forms the chief starting material for the undrawn yarn. The intrinsic viscosity [η] of the PPT used is preferably at least 0.75 and more preferably at least 0.85 in order to enhance the fibre-forming properties at the time of spinning and in order to obtain yarn of practical strength. The oligomer chiefly comprising cyclic dimer which is present in the PPT starting material contaminates the spinneret at the time of spinning and promotes the deposition of needle crystals in the housing below the spinneret, and has an adverse effect on the yarn production properties, so the oligomer content should be made as low as possible, preferably no more than 2 wt %, more preferably no more than 1.5 wt % and still more preferably no more than 1 wt %. Solid phase polymerization is an effective means for reducing the amount of the oligomer. After producing PTT of intrinsic viscosity [η] 0.4 to 0.7 by means of liquid phase polymerization, solid phase polymerization can be carried out at a temperature of 180–215° C., for an exposure time of 2 to 20 hours, under nitrogen, argon or other inert gas, or under a reduced pressure of degree of vacuum below 10 torr, and more preferably below 1 torr. Again, the bis(3-hydroxypropyl)ether produced at the time of polymerization has a tendency to reduce the softening point or lower mechanical properties such as the strength, so the content thereof should be as low as possible, preferably no more than 2 wt %, more preferably no more than 1 wt % and still more preferably no more than 0.5 wt %.

The PPT undrawn yarn can be produced by uninterrupted polymerization and spinning, in which the spinning is performed directly after the polymerization, or chip may first be produced, then this dried or subjected to solid phase polymerization, after which the spinning is performed. However, in order to reduce the oligomer content as described above, it is preferred that chip first be produced and that solid phase polymerization be carried out.

The method of producing the undrawn yarn preferably employed in false-twisting according to the present invention is now explained with reference to the drawings.

With regard to the spinning temperature when carrying out the melt spinning, in order to achieve stable discharge at the spinneret the spinning is preferably carried out at a temperature 15–60° C. higher than the melting point of the PPT, and more preferably it is carried out at a temperature 25–50° C. higher. Again, in order to suppress oligomer deposition during spinning and to enhance the spinning properties, optionally there may be provided under the spinneret a 2–20 cm heating tube or MO (monomer, oligomer) suction means, or a device for generating an inactive gas such as air, steam or $N_2$ for preventing oxidative degradation of the polymer and contamination of the spinneret.

The spinning rate should be set such that, as described above, the strength of the undrawn yarn is at least 1.8 cN/dtex and the residual elongation is 60–180%, and for this purpose the spinning rate is preferably in the range 2500 to 4500 m/min. Again, after spinning, the fibre properties can be stabilized by heat treatment under specified conditions prior to winding-up.

If the spinning rate is less than 2500 m/min, the birefringence will be low, at less than 0.030, so the strength is reduced, and fibrillation and filament wrap-around will tend to arise at the time of false-twisting. If it exceeds 4500 m/min, the yarn will have a so-called drawn yarn structure and will be difficult to deform, so that as well as the crimp characteristics following false-twisting being reduced, there is also a tendency for fibrillation and wrap-around of filaments to occur.

Again, following spinning, it is important that a heat treatment be carried out under specified conditions prior to winding-up, and by carrying out said heat treatment continuously, prior to winding-up, there is achieved a stabilized fibre structure. Changes which occur with passage of time following winding-up are suppressed and it is possible to avoid edge face period unevenness, and differences between the inner and outer layers. For example, in the spinning equipment shown in FIG. 4, the PPT is melted, discharged from spinneret 18 and, while being hauled off using $1^{st}$ godet roll 22, a heat-treatment is carried out by means of heated $1^{st}$ godet roll 22 or $2^{nd}$ godet roll 23, and then winding-up is performed using winding machine 24. Now, the heat-treatment time will depend on the heat-treatment temperature, but from 0.01 to 0.1 second is required so it is preferred that the yarn be passed around heated godet roll 23 a number of times using separating roll 25. A further-preferred heat-treatment time is 0.02 to 0.08 seconds. Moreover, heat treatment is not restricted to the use of the aforesaid heated godet roll and, as shown in FIG. 5, a non-contact heater employing hot air or steam as a heating medium may be provided on the spinning line (between the spinneret and the $1^{st}$ godet roll) or between the godet rolls.

The heat-treatment temperature in the case of a contact-type heater such as a godet roll is preferably 70–130° C. and in the case of a non-contact heater it is preferably 120–220° C. More preferably, for a contact heater it is 100–125° C. and for a non-contact heater it is 140–200° C. Furthermore, it is possible to improve the effectiveness in terms of suppressing package tightening and delayed shrinkage by means of a relaxation treatment following hauling-off by the $1^{st}$ godet roll 22, between the $2^{nd}$ godet roll 23 and the winding machine 24, so this is preferred.

The textured yarn which has been produced and wound-up by the above method may still show package tightening due to delayed shrinkage. In such circumstances, as well as the unwinding properties of the textured yarn being impaired, dyeing unevenness arises in the yarn lengthwise direction as a result of change with passage of time. In order to prevent this, it is preferred that, following the texturing process, the yarn be introduced into a relaxation stage, and it is preferred that a relaxation zone for 5 to 25% relaxation to occur in the room temperature state be provided after the draw texturing and prior to winding-up. Specifically, in FIG. 2 for example, this can readily be realized by slowing the surface velocity of the $3^{rd}$ FR in terms of $2^{nd}$ FR 6. In the relaxation zone, there need not necessarily be carried out heat treatment by means of a heating device, and it is possible to prevent package tightening at room temperature.

Textured yarn which has been obtained by the processing of PPT drawn yarn using a spindle false-twisting device shows considerable variation between spindles, the pass rate in the knitting inspection is about 93% at best, and a considerable cost in entailed in the inspection stage. On the other hand, with the textured yarn produced by the production method of the present invention, it is possible to achieve a knitting inspection pass rate of at least 95%, so that a simplification of the inspection stage is possible, and hence his is preferred. Again, by fully providing the required equipment, it is possible to achieve a knitting inspection pass rate of at least 98%, so it is possible to eliminate the inspection stage, and therefore this is still further preferred.

In addition, in the case of spindle false-twisting which is carried out using drawn yarn of residual elongation less than 60%, it is only possible to achieve a processing rate of, at most, 100 m/min, whereas in the production method of the present invention processing rates of at least 300 m/min are possible. More preferably, it is possible to carry out false-twisting at above 600 m/min and still more preferably at above 800 m/min, and this is industrially advantageous.

In order to enhance the textured yarn high level transit properties, it is preferred that entangling be conferred with the aim of enhancing the yarn convergence. In FIG. 2, entangling is carried out using an entangling nozzle 8 while performing relaxation between the $3^{rd}$ FR 7 and the $4^{th}$ FR 8. Methods for enhancing the convergence include twisting and supplementary oiling, etc, and these may be used where required.

The Young's modulus of PPT fibre is low compared to that of polyethylene terephthalate fibre, so the crimp is soft. However, in order to confer a sense of tightness when formed into cloth, a suitable degree of hardness is required and so textured yarn of deformed cross-section is preferred. In particular, when the cross-sectional shape of the PPT undrawn yarn is round such an effect is considerable, and it is possible to confer a suitable degree of flexural hardness by the sectional shape effect. However, if sectional deformation is produced to a marked extent, glitter and harshness are manifested, so the degree of sectional deformation is preferably 1.3–1.8. In order to achieve this, it is preferred in particular that the yarn temperature at the false-twisted heater outlet be 100–175° C.

Furthermore, when the degree of sectional deformation is 1.3–1.7, a sense of tightness is manifested and there is also little surface reflection, so this is further preferred.

As stated above, the Young's modulus of PPT fibre is low and twist propagation to the upstream twisting region is difficult. In order to improve this, it is preferred that an oil agent or the like be applied to the polypropylene terephthalate undrawn yarn, and that the contact resistance in terms of the heater, cooling plate and the guides, etc, be lowered. When various types of oil agent component were applied to the undrawn yarn for this purpose and draw-texturing carried out, it was discovered that smoothing agent components comprising water-insoluble fatty acid esters and/or aromatic esters were effective. In particular, when 0.05 to 1.0 wt % thereof is applied in terms of the weight of the undrawn yarn, the frictional resistance in terms of the heater, cooling plate and guides is reduced, it is possible to propagate the twist effectively to the upstream twisting region, and it is found that there is little occurrence of fibrillation and little difference in dyeing between spindles or within a spindle. Consequently, it is preferred that water-insoluble fatty acid esters and/or aromatic esters have been applied as a smoothing agent component to the textured yarn following draw-texturing. Oil agents may also provide high level transit properties following the texturing, and such cases too are included.

With regard to the water-insoluble fatty acid esters and/or aromatic esters referred to here, as preferred examples amongst conventional smoothing agents there are esters of monohydric alcohols and monobasic aliphatic carboxylic acids such as methyl oleate, isopropyl myristate, octyl palmitate, oleyl laurate and oleyl oleate, esters of monohydric alcohols and polybasic aliphatic carboxylic acids such as dioctyl sebacate and dioleyl adipate, esters of monohydric alcohols and aromatic carboxylic acids such as dioctyl phthalate and trioleeyl trimellitate, esters of polyhydric alcohols and monobasic aliphatic carboxylic acids such as ethylene glycol dioleate, trimethylol propane tricaprylate and glyceryl trioleate, and derivatives of such esters such as alkylene oxide adduct esters like lauryl (EO) n-octanoate (it is preferred that the number of mols of added alkylene oxide be no more than 5 mols in that, as the compound becomes more water soluble or self-dispersible in water, so the smoothening properties are impaired), and these may be used on their own or in mixtures. However, there is no particular restriction to these examples. If a mineral oil such as liquid paraffin or spindle oil is used on its own, the heat resistance is impaired, so in a preferred example these are used as a mixture not exceeding 40 wt % of the smoothing agent component. Again, the amount of smoothing agent incorporated is not restricted but it is preferably 50–70 wt % of the oil agent components.

It is also preferred that, as well as the smoothing agent, an emulsifier and other additives are included amongst the oil agent components applied to the undrawn yarn.

Conventional emulsifiers can be used as the emulsifier component, suitable examples being nonionic surfactants such as the alkylene oxide adducts of compounds with one or more than one active hydrogen, such as the alkylene oxide adducts of monohydric hydroxy compounds like lauryl alcohol, isostearyl alcohol, oleyl alcohol, octylphenol and nonyl phenol, polyhydric alcohol partial esters such as glyceryl monooleate ester, sorbitan monolaurate ester and trimethylolpropane distearate ester, and the alkylene oxide adducts thereof, alkylene oxide adducts of castor oil, the alkylene oxide adducts of alkylamines like laurylamine and stearylamine, the alkylene oxide adducts of higher fatty acids such as myristic acid, stearic acid and oleic acid, and the alkylene oxide adducts of the amides derived from these fatty acids. Examples of the alkylene oxides here are ethylene oxide, propylene oxide and the like, on their own or used in the form of mixtures. Furthermore, there can also be used, as emulsifiers, polyethylene glycol/polypropylene glycol block copolymers, and anionic surfactants such as the aforesaid higher fatty salts and their triethanolamine or diethanolamine salts, etc, and Turkey red oil or the like. The amount of emulsifier incorporated is not restricted but it is preferably 20–50 wt % of the oily agent components.

Furthermore, besides additives employed in accordance with properties required in the spinning and draw texturing, such as antistatic agents like alkylsulphonate alkali metal salts, alkylphosphate alkali metal salts, polyalkylene glycol alkylphosphate alkali metal salts, fatty acid soaps, alkylimidazolines and the like, there may be used at the same time additives such as conventional converging agents, rust preventives, preservatives, antioxidants and the like. The amount of such additives included is not particularly restricted but it is preferably from 5 to 15 wt %, so that the smoothening properties and heat resistance are not impaired.

Moreover, as a method for determining whether water-insoluble fatty acid ester and/or aromatic ester has been applied to the textured yarn, the oil agent components may be extracted by a methanol extraction method, and determination then performed from the peak positions in the IR spectrum of the extracted components.

There are no restrictions on the PPT textured yarn fineness, the fineness of the individual filaments, and the cross-sectional shape, etc, but normally a multifilament yarn of 33 to 560 dtex and filament fineness 0.11 to 11 dtex is preferably used, and the cross-sectional shape may be round shaped, flat, polygonal such as triagonal, multi-lobed such as trilobal, or hollow, and suitable selection is made according to the application objectives. Furthermore, a multifilament is preferably composed of individual filaments of different fineness and/or cross-sectional shape.

Known textured yarn produced by the spindle texturing of PPT drawn yarn is excellent in its stretchability and bulkiness but there is the problem that there are often dyeing differences between spindles or within a spindle. The main reason for this is because the Young's modulus of PPT drawn yarn is low, so there is poor twist propagation and, furthermore, since the twist tension is low at less than 0.17 cN/dtex the twisting range within the heater varies between spindles and within a spindle. In contrast, with the PPT textured yarn obtained by the method of the present invention, there is little difference in dyeing between spindles and within a spindle, and there is little fibrillation, so textured yarn of high product quality is formed.

EXAMPLES

Below, the present invention is explained in further detail by means of examples. Now, in the examples the properties were determined by the following methods.

A. Intrinsic Viscosity

This was obtained using o-chlorophenol solutions of the sample, with the relative viscosity at 25° C. being determined at various points by means of an Ostwald viscometer, and then extrapolation performed to zero concentration.

B. Strength/Elongation

These were measured for the undrawn yarn under the constant rate of extension conditions as described in JIS L1013 (Test Methods for Man-Made Filament Yarns) using a Tensilon UCT-100 made by the Orientec Co. The elongation at break was determined from the elongation at the point of maximum tenacity on the stress-strain curve.

C. Birefringence

The retardation Γ and the optical path length d were measured for the undrawn yam using a BH-2 polarizing microscope made by the Olympus Co., and the birefringence was determined from the relationship $\Delta n=\Gamma/d$.

D. Boiling Water Shrinkage

Measurement was carried out based on JIS L 1013 (Test Methods for Man-Made Filament Yarns). From the undrawn yarn package, a hank was taken using a counter wheel, and the hank length $L_1$ measured with a length measurement load of $90\times10^{-3}$ cN/dtex applied. Then this length measurement load was removed and the hank introduced into boiling water for 15 minutes, after which it was removed, air dried, the length measurement load again applied and hank length $L_2$ measured. The boiling water shrinkage was calculated using the following formula.

$$\text{boiling water shrinkage } (\%)=[(L_1-L_2)/L_1]\times100$$

E. Uster Unevenness

The yarn lengthwise direction thickness unevenness (normal test) was measured using an Uster Tester Monitor C made by the Zellweger-Uster Co. The conditions were a yarn supply rate of 50 m/min for 1 minute, and the mean deviation (U%) was measured in normal mode.

F. Saddle and Bulging

Figure 6:
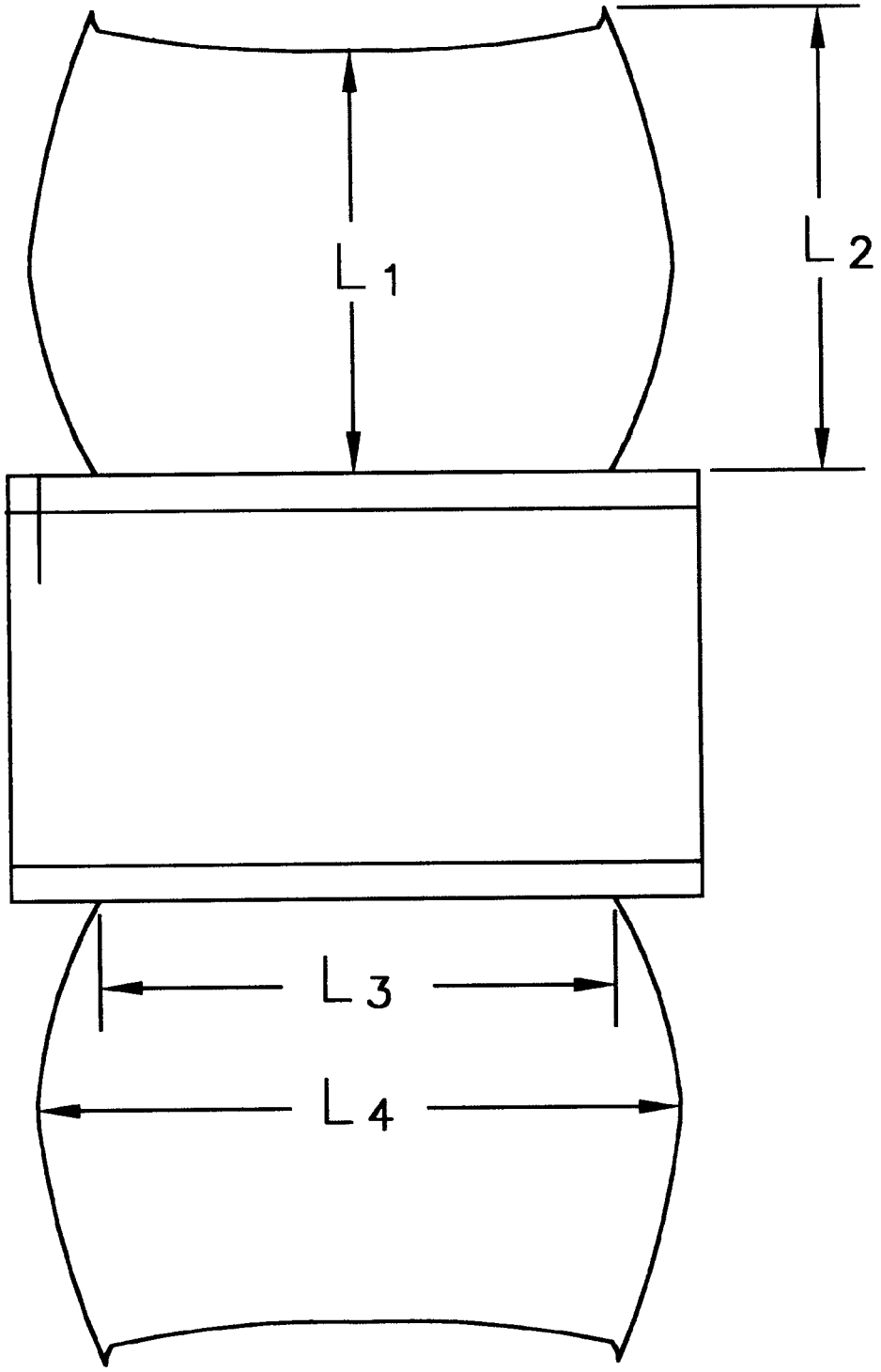
FIG. 6: This is a model diagram for explaining the saddle and the bulging factor in the case of the undrawn yarn package preferably used in the present invention.

As shown in FIG. 6, the wound thickness $L_1$ in the centre region of the undrawn yarn package and the wound thickness at the end face $L_2$ were measured, and the value of $L_2$ minur $L_1$ was taken as the magnitude of the saddle. Furthermore, the wound width $L_3$ of the innermost layer in the undrawn yarn package as shown in FIG. 6 and $L_4$ which denotes the greatest wound width were measured, and the percentage bulging calculated by means of the following formula.

$$\text{bulging}(\%)=(L_4-L_3)/L_3\times100$$

G. Measurement of the Yarn Temperature at the Heater Outlet

The yarn temperature was measured right after the heater outlet using an instrument sold by Tokyo Seiko Co. Ltd, power source region: TS-3A, detector end: EC-2.

H. Yarn Tension

This was measured using a digital tension meter IT-200 produced by Intec.

I. Number of Twists within Heater

The line was simultaneously grasped at the heater inlet and outlet regions during the false-twisting process and the yarn within the heater sampled. Then, using a motor-operated twist detector, the number of twists T (T/m) was measured under a $90\times10^{-3}$ cN/dtex load.

J. Degree of Sectional Deformation

The yarn was cut perpendicular to the yarn lengthwise direction and a slice taken. A micrograph of the cross-section was recorded using an optical microscope. From the micrograph of the cross-section, there was obtained for each single fibre the value of the ratio of the diameter of the circumscribed circle to the diameter of the inscribed circle, divided by the ratio of the diameter of circumscribed circle to the diameter of the inscribed circle in the case of the yarn supplied to the false-twisting process, and the average value calculated.

K. Percentage Recovery of Shrinkage: RS

Textured yarn which had been left for 1 week on the package was sampled, and a small hank produced in accordance with JIS L1090-1992, 5.8 Percentage Shrinkage Recovery. After leaving to contract for 24 hours, it was immersed for 30 minutes in hot water at 98° C. wrapped with coarse cloth. Thereafter, the sample was withdrawn and allowed to dry naturally for 24 hours on filter paper, and then the sample measured in accordance with 5.8 Percentage Shrinkage Recovery.

L. Knitting Inspection

The outermost surface of a textured yarn cheese was removed and, using a circular knitting machine of suitable gauge number, after adjusting the density, circular knitting was carried out in turn such that there were adjacent levels for comparison. Based on the knitted material weight, 0.3% (owf) of Sumikaron Navy Blue S-2GL 200 (produced by the Sumitomo Chemical Co.), 5.0% (owf) of Tetrosin PEC (produced by Yamakawa Chemical Industry Co.) and 1.0% Nicca Sansolt #1200 (produced by Nikka Chemical Co.) were uniformly dispersed in 50 times the quantity of water as weight of knitted material. After adjusting to 50° C., the knitted material was introduced and, while suitably stirring, the temperature was raised to 98° C. at 1–2° C. per minute, followed by 20 minutes heating, after which slow cooling was performed and the sample dyed. With regard to the knitting inspection, the L value of the knitted material was measured using a calorimeter. When the average value for all was within ±0.4, the sample was regarded as having passed the text. Samples lying outside this range failed the test.

Example 1

Figure 3:
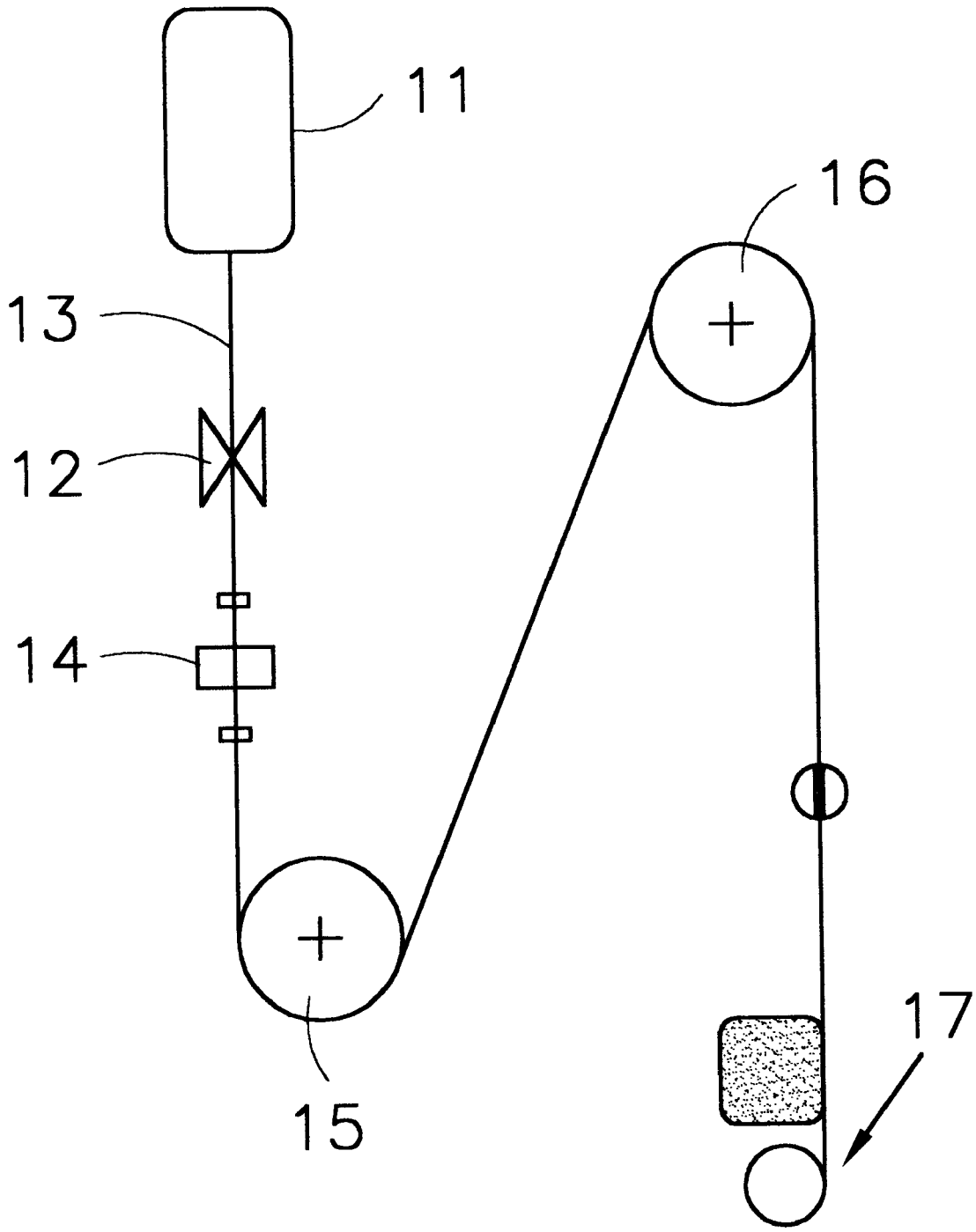
FIG. 3: This is a process diagram showing an example of the spinning equipment for obtaining highly-oriented undrawn yarn.

PPT of intrinsic viscosity [η] 0.89 was spun by means of the spinning machine shown in FIG. 3 at a spinning temperature of 260° C. using a spinneret with 36 holes of round shape, and highly-oriented undrawn yarn was wound-up over 2 hours at a spinning rate of 3000 m/min. At the time of wind-up, using an oiling guide, the undrawn yarn was oiled with an oil agent in which a smoothing agent, emulsifier and additives had been dispersed, and there was applied 0.2 wt % of oleyl laurate in terms of the weight of the undrawn yarn. The properties of the undrawn yarn are shown in Table 1. The measurement of the properties was carried out immediately after winding-up. Following wind-up, the highly oriented undrawn yarn was directly subjected to draw texturing under the conditions in Table 2 using the false-twisting machine shown in FIG. 2. Now, as heater 3, there was used a 2.5 m dry-heat heater, and as frictional false-twisting device 5 there was employed a triaxial twister constructed of, from the upstream side, one ceramic disc, six urethane discs and one ceramic disc. Again, compared to the $2^{nd}$ FR 6, the velocity of the $3^{rd}$ FR 7 was 18% slower and no entangling nozzle 8 was used. The false-twisting could be carried out stably and it was possible to obtain a bulky textured yarn. The textured yarn properties are shown in Table 3. The textured yarn was subjected to circular knitting using a 27G circular knitting machine and when a knitting inspection was carried out, no dyeing differences were noted between the inner and outer layers of the undrawn yarn package.

Comparative Example 1

PPT of intrinsic viscosity [η] 0.89 was spun by means of the spinning machine shown in FIG. 3 at a spinning temperature of 260° C. using a spinneret with 36 holes of round shape, and undrawn yarn was wound-up at a spinning rate of 1500 m/min.

After winding-up for 5 hours, the yarn was left for 1 week in a room at 25° C. and 80% relative humidity. The package of undrawn polypropylene terephthalate yarn exhibited package tightening, the centre region was large compared to the end face and a depressed shape was formed. The properties of the undrawn yarn after leaving for 1 week are shown in Table 1. Using identical equipment to that in Example 1, draw texturing was carried out under the conditions shown in Table 2. The false-twisting process was rather unstable and there were many yarn breaks. The properties of the textured yarn are shown in Table 3. The textured yarn was subjected to circular knitting using a 27G circular knitting machine and when a knitting inspection was carried out, a marked difference in dyeing was noted between the inner and outer layers of the undrawn yarn package and unevenness coinciding with the edge face period was observed, so there were problems in terms of product quality.

Comparative Example 2

PPT of intrinsic viscosity [η] 0.89 was spun by means of the spinning machine shown in FIG. 3 at a spinning temperature of 260° C. using a spinneret with 36 holes of round shape, and undrawn yarn was wound-up at a spinning rate of 2000 m/min.

After winding-up for 5 hours, the yarn was left for 1 week in a room at 25° C. and 80% relative humidity. The package of undrawn polypropylene terephthalate yarn exhibited package tightening, the centre region was large compared to the end face and a depressed shape was formed. The properties of the undrawn yarn after leaving for 1 week are shown in Table 1. Using identical equipment to that in Example 1, draw texturing was carried out under the conditions shown in Table 2. The false-twisting process was rather unstable and there were many yarn breaks. The properties of the textured yarn are shown in Table 3. The textured yarn was subjected to circular knitting using a 27G circular knitting machine and when a knitting inspection was carried out, a marked difference in dyeing was noted between the inner and outer layers of the undrawn yarn package and unevenness coinciding with the edge face period was observed, so there were problems in terms of product quality.

Comparative Example 3

PPT of intrinsic viscosity [η] 0.89 was spun at a spinning temperature of 260° C. using a spinneret with 36 holes of round shape, and undrawn yarn wound-up at a spinning rate of 1200 m/min. Next, drawing was carried out at a drawing rate of 600 m/min, at a $1^{st}$ hot roll temperature of 60° C., a draw ratio of 3 and a $2^{nd}$ hot roll temperature of 140° C., after which the yarn was wound-up using a spindle wind-up device and 56 dtex/36f drawn yarn obtained. Using this drawn yarn, false-twisting was carried out under the conditions in Table 2 employing a 1 m dry-heat heater and a spindle false-twisting device. The spindle rotation rate was set to 4100 rpm. When 100 kg of texturing was continuously carried out, to produce 100 units of 1 kg wound textured yarn, despite the processing rate being low at 100 m/min, the percentage of yarn breaks reached 5% and, furthermore, the pass rate in the textured yarn knitting inspection was only 92%.

Examples 2 to 4

Figure 4:
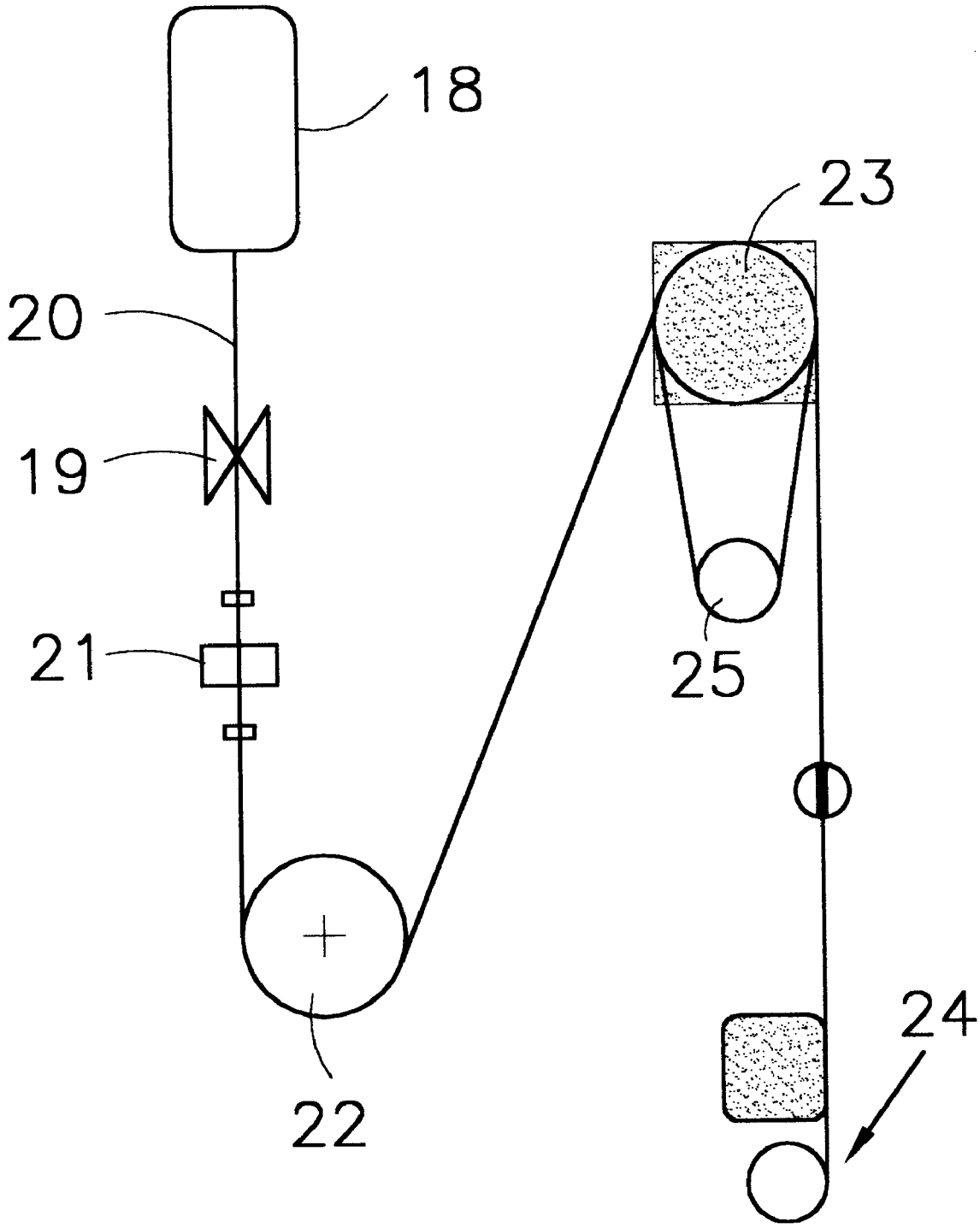
FIG. 4: This is a process diagram showing an example of spinning equipment where a hot roll has been incorporated as the second godet roll.
Figure 5:
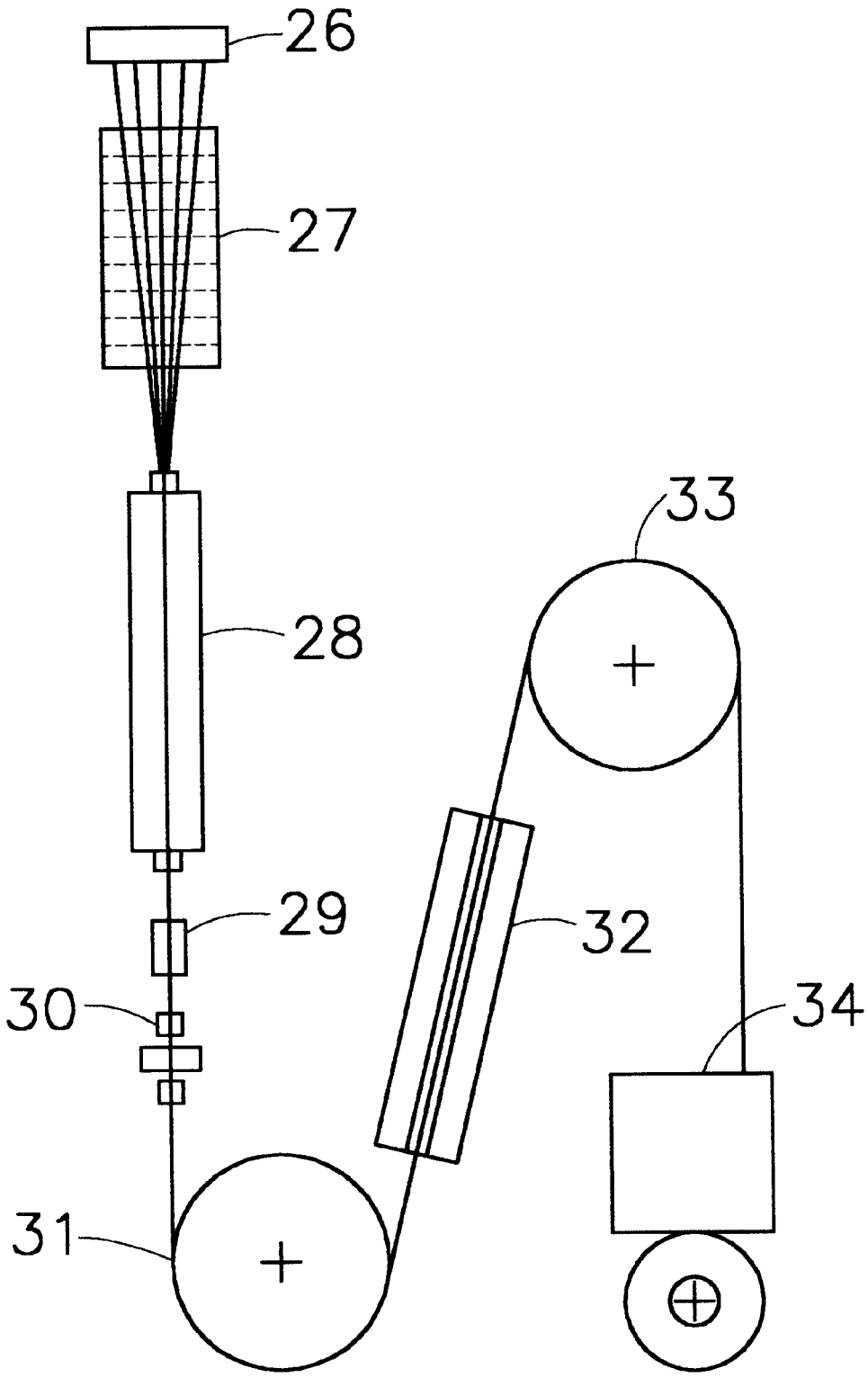
FIG. 5: This is a process diagram showing an example of spinning equipment where a non-contact heater is incorporated on the spinning line.

PPT of intrinsic viscosity [η] 0.89 was spun by means of the spinning machine shown in FIG. 4 at a spinning temperature of 260° C. using a spinneret with 36 holes of round shape, and while haulint-off at a rate of 3000 m/min a dry heat treatment was carried out with two godet rolls heated to 110° C. after which the undrawn yarn was wound- up. At that time, using an oiling guide the undrawn yarn was oiled with an oil agent in which a smoothing agent, emulsifier and additives had been dispersed and there was applied 0.2 wt % of oleyl laurate in terms of the weight of the undrawn yarn.

The yarn was left for 1 week under the same conditions as in Comparative Example 1, but no tightening on the undrawn yarn package was produced. After leaving for 1 week, the properties of the undrawn yarn were as shown in Table 1. Using this undrawn yarn, draw texturing was carried out with the same device and under the same processing conditions as in Example 1, except that the heater temperature was as shown in Table 2. The false-twisting could be carried out stably and it was possible to obtain a bulky textured yarn. The textured yarn was subjected to circular knitting using a 27G circular knitting machine and when a knitting inspection was carried out, no dyeing differences were noted between the inner and outer layers of the undrawn yarn package. Furthermore, as the false-twisting temperature became higher, so the crimp became stronger and the yarn bulkier, and the degree of sectional deformation became greater, so the flexural hardness of the filaments increased and there was a suitable tightness of feel.

Comparative Examples 4 and 5

Using the same kind of undrawn yarn as in Examples 2 to 4, draw texturing was carried out under the conditions shown in Table 2. The false-twisting device was the same as in Example 1 and, excepting for the draw ratio, the draw texturing was carried out under the same conditions as in Example 3. However, in Comparative Example 4, ballooning was produced in the twisting zone and the unwinding tension fluctuated, so processing was unstable. On the other hand, in Comparative Example 5, yarn breakage occurred during start-up and it was not possible to obtain textured yarn. The draw-textured yarn properties in the case of Comparative Example 4 are shown in Table 3. The textured yarn was subjected to circular knitting using a 27G circular knitting machine and when a knitting inspection was carried out, dyeing unevenness was noted in the yarn lengthwise direction and there were problems in terms of product quality.

Example 5

Using the same kind of undrawn yarn as in Examples 2 to 4, draw texturing was carried out under the conditions shown in Table 2. As the false-twisting device, there was employed a TFT-15 made by the Toray Engineering Co. (using a 1 m non-contact type high temperature heater as the heater). Furthermore, the velocity of the $3^{rd}$ FR 7 was slowed 15% compared to the $2^{nd}$ FR 6, and no entangling was conferred. When there was continuously carried out the draw texturing of 500 kg of undrawn yarn and 100 units of 5 kg wound yarn were produced, it was possible to produce high quality textured yarn with a percentage of yarn breaks of 1% and a pass rate in the knitting inspection of 98%.

Examples 6 and 7

PPT of intrinsic viscosity [η] 0.89 was spun by means of the spinning machine shown in FIG. 5 at a spinning temperature of 260° C. using a spinneret 26 with 36 holes of round shape and, after cooling the yarn in chimney 27 to below the Tg, a heat treatment was carried out with a non-contact heater 28 (heating length: 1.5 m, heating medium: air heated to 180° C. ) positioned 1.6 m below the spinneret and undrawn yarn was wound up at a rate of 3500 m/min. At the time of wind-up, using oiling device 29 the undrawn yarn was oiled with an oil agent in which a smoothing agent, emulsifier and additives had been dispersed and there was applied 0.2 wt % of oleyl laurate in terms of the weight of the undrawn yarn. The yarn was left for 1 week under the same conditions as in Comparative Example 1, but no tightening of the undrawn yarn package was produced. After leaving for 1 week, the properties of the undrawn yarn were as shown in Table 1. Using this undrawn yarn, draw texturing was carried out with the same device as in Example 1, using the processing conditions shown in Table 2. The false-twisting could be carried out stably and it was possible to obtain a bulky textured yarn. The textured yarn was subjected to circular knitting using a 27G circular knitting machine and when a knitting inspection was carried out, no dyeing differences were noted between the inner and outer layers of the undrawn yarn package, or corresponding to the edge face period.

Example 8

PPT of intrinsic viscosity [η] 0.89 was spun by means of the spinning machine shown in FIG. 4 at a spinning temperature of 260° C. using a spinneret with 36 holes of round shape and while hauling-off at a rate of 2600 m/min a dry heat treatment was carried out with the two godet rolls heated to 110° C. after which the undrawn yarn was wound-up. At the time of wind-up, using an oiling guide the undrawn yarn was oiled with an oil agent in which a smoothing agent, emulsifier and additives had been dispersed and there was applied 0.2 wt % of oleyl laurate in terms of the weight of the undrawn yarn. The yarn was left for 1 week under the same conditions as in Comparative Example 1, but no tightening on the undrawn yarn package was produced. After leaving for 1 week, the properties of the undrawn yarn were as shown in Table 1. Using this undrawn yarn, draw texturing was carried out with the same device as in Example 1, employing processing conditions as shown in Table 2, and it was possible to obtain a bulky textured yarn. The textured yarn was subjected to circular knitting using a 27G circular knitting machine and when a knitting inspection was carried out, no dyeing differences were noted between the inner and outer layers of the undrawn yarn package.

Effects of the Invention

In accordance with the present invention, it is possible to produce, at low cost, polypropylene terephthalate textured yarn with little dyeing unevenness or fibrillation, and which is outstanding in its product quality. Not only is this textured yarn excellent in its stretchability and bulkiness, but it forms fabric having a suitable sense of tightness.

TABLE 1

| | Spinning Rate (m/min) | Strength ST (cN/dtex) | Birefringence ($\times 10^{-3}$) | Elongation EL (%) | Boiling Water Shrinkage (%) | Uster Unevenness (U%) | Saddle (mm) | Bulging Factor (%) | 0.585 × (1 + EL/100) | 0.75 × (1 + EL/100) |
|---|---|---|---|---|---|---|---|---|---|---|
| Example 1 | 3000 | 2.6 | 52.5 | 119 | 40 | 1.22 | 4.2 | 5 | 1.28 | 1.64 |
| Comp. Ex. 1 | 1500 | 1.4 | 23.1 | 300 | 52 | 1.98 | 5.5 | 11 | — | — |
| Comp. Ex. 2 | 2000 | 1.8 | 34.9 | 195 | 56 | 1.43 | 4.4 | 7 | 1.73 | 2.21 |
| Examples 2 to 5 | 3000 | 2.5 | 43.8 | 98.5 | 6.6 | 0.98 | 2.5 | 5 | 1.16 | 1.49 |
| Comp. Ex 4 and 5 | | | | | | | | | | |
| Examples 6 and 7 | 3500 | 3.1 | 57.8 | 76.5 | 9.0 | 0.60 | 2.0 | 4 | 1.03 | 1.32 |
| Example 8 | 2600 | 2.0 | 43.7 | 158 | 6.0 | 0.96 | 1.8 | 4 | 1.51 | 1.93 |

TABLE 2

| | Processing Rate (m/min) | Draw Ratio DR | Yarn Temp. at Heater Outlet (° C.) | $T_1$ (cN/dtex) | $T_1/T_H$ | False Twist No. T(×D½) |
|---|---|---|---|---|---|---|
| Example 1 | 300 | 1.4 | 150 | 0.35 | 1.18 | 28400 |
| Example 2 | 300 | 1.4 | 100 | 0.36 | 1.24 | 27900 |

TABLE 2-continued

| | Processing Rate (m/min) | Draw Ratio DR | Yarn Temp. at Heater Outlet (° C.) | $T_1$ (cN/dtex) | $T_1/T_H$ | False Twist No. T(×D½) |
|---|---|---|---|---|---|---|
| Example 3 | 300 | 1.4 | 150 | 0.35 | 1.18 | 28400 |
| Example 4 | 300 | 1.4 | 175 | 0.34 | 1.15 | 28700 |
| Example 5 | 600 | 1.4 | 150 | 0.34 | 1.15 | 28800 |
| Comparative Ex. 1 | 100 | 2.67 | 100 | 0.37 | 1.32 | 27200 |
| Comparative Ex. 2 | 100 | 2.0 | 100 | 0.37 | 1.31 | 27600 |
| Comparative Ex. 3 | 100 | 1.03 | 150 | 0.13 | 1.25 | 30400 |
| Comparative Ex. 4 | 300 | 1.15 | 150 | 0.23 | 1.32 | 27100 |
| Comparative Ex. 5 | 300 | 1.55 | 150 | — | — | — |
| Example 6 | 300 | 1.05 | 130 | 0.18 | 1.03 | 28700 |
| Example 7 | 300 | 1.10 | 150 | 0.25 | 1.11 | 28800 |
| Example 8 | 300 | 1.65 | 150 | 0.35 | 1.16 | 28500 |

TABLE 3

| | Fineness (dtex) | Strength ST (cN/dtex) | Elongation EL (%) | RS (%) | Degree Of Sectional Deformation | Boiling Water Shrinkage SW (%) |
|---|---|---|---|---|---|---|
| Example 1 | 58 | 2.9 | 36 | 45 | 1.5 | 9 |
| Example 2 | 58 | 2.7 | 36 | 42 | 1.4 | 11 |
| Example 3 | 58 | 2.9 | 38 | 45 | 1.5 | 9 |
| Example 4 | 58 | 3.0 | 33 | 45 | 1.8 | 8 |
| Example 5 | 58 | 3.0 | 38 | 48 | 1.6 | 9 |
| Comparative Ex. 1 | 56 | 2.5 | 38 | 40 | 1.6 | 9 |
| Comparative Ex. 2 | 56 | 2.7 | 37 | 40 | 1.6 | 9 |
| Comparative Ex. 3 | 53 | 2.8 | 35 | 48 | 1.1 | 9 |
| Comparative Ex. 4 | 70 | 2.6 | 64 | 32 | 1.3 | 9 |
| Example 6 | 98 | 2.8 | 50 | 43 | 1.2 | 9 |
| Example 7 | 103 | 2.9 | 43 | 44 | 1.3 | 10 |
| Example 8 | 59 | 2.8 | 41 | 45 | 1.6 | 9 |

What is claimed is:

1. A method of producing polypropylene terephthalate textured yarn which is characterized in that, when carrying out texturing at the same time as drawing using a frictional false-twisting machine, at the same time as setting the draw ratio of the polypropylene terephthalate undrawn yarn to a draw ratio in the range 1.05 to 1.70, the elongation EL (%) of the undrawn yarn and the draw ratio DR are set so that the following relationship (1) is satisfied $$0.585\times(1+EL/100)\leqq DR\leqq 0.75\times(1+EL/100) \qquad \text{Relationship (1).}$$

2. A method of producing polypropylene terephthalate textured yarn according to claim 1 which is characterized in that the draw ratio is from 1.05 to 1.60.

3. A method of producing polypropylene terephthalate textured yarn according to claim 2 which is characterized in that the draw ratio is from 1.10 to 1.50.

4. A method of producing polypropylene terephthalate textured yarn according to claim 1 which is characterized in that the yarn temperature at the texturing heater outlet is from 30 to 175° C.

5. A method of producing polypropylene terephthalate textured yarn according to claim 1 which is characterized in that the yarn temperature at the texturing heater outlet is from 110 to 160° C.

6. A method of producing polypropylene terephthalate textured yarn according to claim 1 which is characterized in that the texturing tension $T_1$ is from 0.17 to 0.55 cN/dtex.

7. A method of producing polypropylene terephthalate textured yarn according to claim 1 which is characterized in that the ratio $T_1/T_H$ of the texturing tension $T_1$ to the tension in front of the heater $T_H$ is from 1.02 to 1.30.

8. A method of producing polypropylene terephthalate textured yarn according to claim 1 which is characterized in that the number of twists T inside the heater is from $27400/D^{1/2}$ to $30600/D^{1/2}$.

9. A method of producing polypropylene terephthalate textured yarn according to claim 1 which is characterized in that a non-contact type heater is used as the heater.

10. A method of producing polypropylene terephthalate textured yarn according to claim 1 which is characterized in that there is used polypropylene terephthalate undrawn yarn which satisfies the following relationships (1) to (4);

(1) strength ST (cN/dtex): $1.8\leqq ST$ (2) birefringence $\Delta n$ ($\times 10^{-3}$): $30\leqq \Delta n\leqq 70$ (3) elongation EL (%): $60\leqq EL\leqq 180$ (4) boiling water shrinkage SW (%): $3\leqq SW\leqq 15$.

11. A method of producing polypropylene terephthalate textured yarn according to claim 10 which is characterized in that the yarn thickness variation U % (normal mode) of no more than 1% is used as the undrawn yarn.

12. A method of producing polypropylene terephthalate textured yarn according to claim 10 which is characterized in that there is used an undrawn yarn package of saddle less than 4 mm and bulging factor less than 10%.

13. A method of producing polypropylene terephthalate textured yarn according to claim 10 which is characterized in that there is used, as the supplied raw yarn, undrawn yarn obtained by melt spinning polyester in which polypropylene terephthalate is the chief component and then cooling and solidifying the spun yarn, after which the yarn is hauled-off at a spinning rate of 2500–4500 m/min and, furthermore, heat-treated for a heat-treatment time of at least 0.01 second and wound up.

14. A method of producing polypropylene terephthalate textured yarn according to claim 13 which is characterized in that, as the supplied raw yarn, there is used undrawn yarn obtained by carrying out the heat-treatment at a temperature in the range 70 to 130° C. employing a contact type heater, and then winding up.

15. A method of producing polypropylene terephthalate textured yarn according to claim 13 which is characterized in that, as the supplied raw yarn, there is used undrawn yarn obtained by carrying out the heat-treatment at a temperature in the range 120 to 220° C. employing a non-contact type heater, and then winding up.

16. A method of producing polypropylene terephthalate textured yarn according to claim 1 which is characterized in that after the draw texturing, up to the winding-up, there is provided a relaxation zone where the relaxation factor is 5 to 25%.

17. A method of producing polypropylene terephthalate textured yarn according to claim 1 which is characterized in that the draw texturing processing rate is at least 300 m/min.

18. Polypropylene terephthalate textured yarn which is characterized in that it is produced by a method according to any of claim 1.

19. Polypropylene terephthalate textured yarn according to claim 18 which is characterized in that the degree of cross-sectional deformation is 1.3 to 1.8.

20. Polypropylene terephthalate textured yarn according to claim 18 which is characterized in that there has been applied as a smoothing agent component a water-insoluble aliphatic ester and/or aromatic ester.

* * * * *